US010053937B2

(12) United States Patent
Richards et al.

(10) Patent No.: US 10,053,937 B2
(45) Date of Patent: Aug. 21, 2018

(54) PRODUCTION PACKER-SETTING TOOL WITH ELECTRICAL CONTROL LINE

(71) Applicant: Halliburton Energy Services, Inc., Houston, TX (US)

(72) Inventors: William Mark Richards, Flower Mound, TX (US); Timothy Rather Tips, Montgomery, TX (US); James Andrew Flygare, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 113 days.

(21) Appl. No.: 14/899,493

(22) PCT Filed: Aug. 16, 2013

(86) PCT No.: PCT/US2013/055408

§ 371 (c)(1),
(2) Date: Dec. 17, 2015

(87) PCT Pub. No.: WO2015/023300

PCT Pub. Date: Feb. 19, 2015

(65) Prior Publication Data

US 2016/0145958 A1 May 26, 2016

(51) Int. Cl.
*E21B 23/04* (2006.01)
*E21B 23/06* (2006.01)
(Continued)

(52) U.S. Cl.
CPC ..... *E21B 23/06* (2013.01); *E21B 17/003* (2013.01); *E21B 23/04* (2013.01); *E21B 23/065* (2013.01); *E21B 33/12* (2013.01); *E21B 33/129* (2013.01)

(58) Field of Classification Search
CPC ..... E21B 23/04; E21B 23/06; E21B 23/065; E21B 23/10; E21B 33/128; E21B 33/1285; E21B 33/129; E21B 33/1295
See application file for complete search history.

(56) References Cited

U.S. PATENT DOCUMENTS 2,701,614 A * 2/1955 Ragan ..... E21B 23/065 166/120
3,125,162 A * 3/1964 Briggs et al. ..... E21B 23/06 166/123

(Continued)

FOREIGN PATENT DOCUMENTS

WO 2009139806 11/2009

OTHER PUBLICATIONS

International Patent Application No. PCT/US2013/055408, International Search Report and Written Opinion dated May 19, 2014, 15 pages.

*Primary Examiner* — Cathleen R Hutchins
(74) *Attorney, Agent, or Firm* — Kilpatrick Townsend & Stockton LLP

(57) ABSTRACT

Certain aspects are directed to tools for setting production packers or actuating other downhole tools in response to activation signals received via an electrical control line within the wellbore. In one aspect, a downhole assembly for a wellbore is provided. The downhole assembly can include a reservoir and a pressuring module in fluid communication with the reservoir. The reservoir can contain a control fluid in communication with a fluid control path of a downhole tool. A quantity of the control fluid can be transmitted via the fluid control path for actuation of the downhole tool. The quantity of the control fluid can be controlled using a pressure change in the control fluid. The pressure change in the control fluid can be caused by the pressurizing module (Continued)

in response to an activation signal received by the pressurizing module via an electrical control line coupled to the pressurizing module.

17 Claims, 8 Drawing Sheets

(51) Int. Cl.

| | |
|---|---|
| ***E21B 33/128*** | (2006.01) |
| ***E21B 33/129*** | (2006.01) |
| ***E21B 33/1295*** | (2006.01) |
| ***E21B 17/00*** | (2006.01) |
| ***E21B 33/12*** | (2006.01) |

(56) References Cited

U.S. PATENT DOCUMENTS

| | | | | |
|---|---|---|---|---|
| 5,137,086 | A * | 8/1992 | Stokley | E21B 49/082 166/191 |
| 5,295,393 | A * | 3/1994 | Thiercelin | E21B 33/1243 166/271 |
| 5,893,413 | A * | 4/1999 | Lembcke | E21B 23/04 166/321 |
| 6,945,330 | B2 * | 9/2005 | Wilson | E21B 23/00 166/179 |
| 7,775,284 | B2 | 8/2010 | Richards et al. | |
| 7,857,061 | B2 | 12/2010 | Richards | |
| 8,074,719 | B2 | 12/2011 | Richards | |
| 8,201,632 | B2 | 6/2012 | Burnett | |
| 2003/0196820 | A1 | 10/2003 | Patel | |
| 2009/0255692 | A1 | 10/2009 | Coronado | |
| 2013/0014959 | A1 | 1/2013 | Tips et al. | |

* cited by examiner

PRODUCTION PACKER-SETTING TOOL WITH ELECTRICAL CONTROL LINE

CROSS-REFERENCE TO RELATED APPLICATIONS

This is a U.S. national phase under 35 U.S.C. 371 of International Patent Application No. PCT/US2013/055408, titled "PRODUCTION PACKER-SETTING TOOL WITH ELECTRICAL CONTROL LINE" and filed Aug. 16, 2013, which is incorporated herein by reference in its entirety

TECHNICAL FIELD OF THE DISCLOSURE

The present disclosure relates generally to devices for use in a wellbore in a subterranean formation and, more particularly (although not necessarily exclusively), to tools for setting production packers via an electrical control line.

BACKGROUND

Various devices can be utilized in a well traversing a hydrocarbon-bearing subterranean formation. For example, a packer device may be installed along production tubing in the well by applying a force to an elastomeric element of the packer. The elastomeric element may expand in response to the force. Expansion of the elastomeric element may restrict the flow of fluid through an annulus between the packer and the tubing.

Tubing pressure may be utilized to set a packer in the well. This process may begin by plugging the tubing. The plugged tubing can be flooded with fluid to produce a pressure within the tubing. A port in the tubing string may communicate the tubing pressure to the packer. The tubing pressure can apply force to the elastomeric element to set the packer.

Tubing pressure may also be utilized to actuate multiple tools disposed along a production tubing string in the well. To utilize multiple tools actuated by tubing pressure in a common section of tubing, the tools may actuate at different pressures. In one example, a first packer may be configured to set at a low pressure, and a second packer may be configured to set at a high pressure. The tubing may be plugged and pressurized to the low pressure to set the first packer. The tubing pressure may be further raised to reach the high pressure and set the second packer.

Using a second packer that is configured to actuate at a higher pressure than a first packer may prevent the second packer from being set before the first packer. It may not be feasible to change the order in which multiple tools are actuated by tubing pressure after the tools have been configured and disposed in the well.

DETAILED DESCRIPTION

Figure 1:
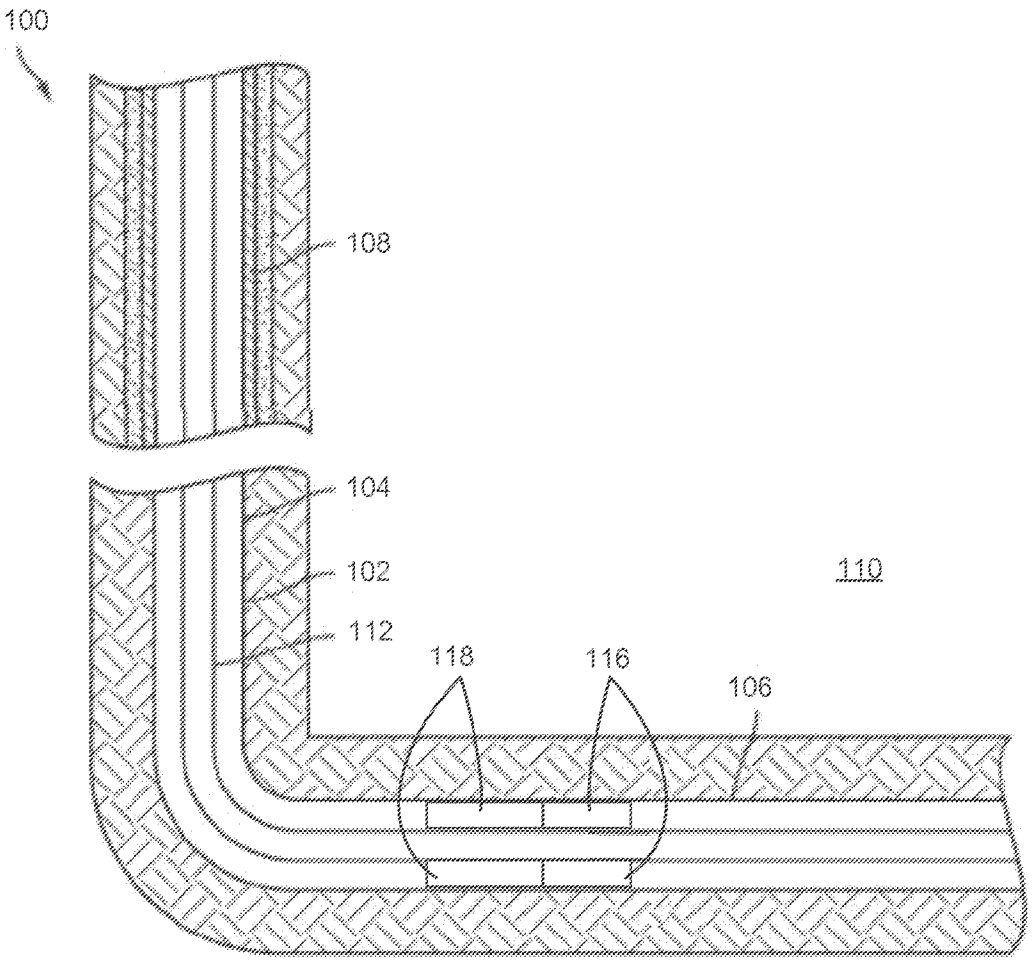
FIG. 1 is a schematic illustration of a well system having a packer-setting tool utilizing an electrical control line according to one aspect of the present disclosure.

Certain aspects and examples of the present disclosure are directed to tools for setting production packers downhole via an electrical control line. For example, a setting tool connected via a fluid control path to a production packer can produce fluid pressure in the fluid control path in response to a signal received via an electrical control line. The fluid pressure in the control line can be used to set the packer.

In some aspects, a setting tool is provided that can be disposed in a wellbore through a fluid-producing formation. The setting tool can include a reservoir containing a control fluid, an electrical control line, and a pressurizing module electrically coupled to the electrical control line and proximate to the reservoir. The control fluid can be in fluid communication with a fluid control path of a downhole tool. Non-limiting examples of the fluid control path include a control line, tubing, and a long drilled hole in a mandrel. The downhole tool can actuate in response to at least a quantity of control fluid being communicated via the fluid control path. Non-limiting examples of the downhole tool include a packer, a sliding sleeve, and a valve. The pressurizing module can receive an activation signal via the electrical control line. The pressurizing module can produce a pressure change in the control fluid in response to the activation signal. The pressure change can cause the quantity of control fluid to be communicated via the fluid control path.

In additional or alternative aspects, the pressurizing module can include a pressurizing sleeve and a setting element.

The pressurizing sleeve can be positioned adjacent to the reservoir. The setting element can be positioned adjacent to the pressurizing sleeve. Non-limiting examples of a setting element include a setting sleeve, one or more pistons, and an actuator. The setting element can move in response to the activation signal received via the electrical control line. Movement of the setting element can cause the pressurizing sleeve to move. Movement of the pressurizing sleeve can change a volume of the reservoir. Changing the volume of the reservoir can cause control fluid to flow through the fluid control path to actuate the downhole tool.

In additional or alternative aspects, the pressurizing module can include a pump. The pump can be controlled by a controller in response to one or more activation signals received by the controller via the electrical control line. The controller can also transmit feedback signals via the electrical control line. For example, feedback signals may include pressure information indicating the pressure generated by the pump. In one non-limiting example, the pressure information is provided by a transducer. In another non-limiting example, the pressure information is based on the voltage applied to the pump. The voltage applied to the pump may have a known correlation to a pressure supplied by the pump. For example, the pressure supplied by the pump may increase in relation to the voltage applied to the pump.

In some aspects, the electrical control line can be a dedicated control line for the controller. In other aspects, the electrical control line can be connected to other downhole devices in addition to the controller. The controller can be addressable such that the controller is configured to distinguish an activation signal or other signal addressed to the controller from signals address to other downhole devices connected to the control line. For example, the controller can be addressable via an internet protocol ("IP") address or other suitable identifier. In some aspects, using an addressable controller can allow a packer to be set without using a port to the tubing string.

In additional or alternative aspects, the controller can identify a control unit accessible via the electrical control line, such as (but not limited to) a control unit located on a rig at the surface of a wellbore. The controller can communicate a feedback signal or other data to the identified control unit via the electrical control line. The feedback signal or other data communicated to the identified control unit can provide confirmation that a packer has been properly set. In additional or alternative aspects, the controller can store data corresponding to the operation of the pump and/or a packer-setting operation. The stored data can be retrieved via any suitable mechanism.

In additional or alternative aspects, the setting tool can be included in a downhole assembly along with a packer that can be set by the setting tool. The packer can include a chamber in fluid communication with the reservoir of the setting tool, one or more compression elements, and one or more elastomeric elements. A compression element of the packer can be in fluid communication with the chamber. The compression element can move in response to control fluid being communicated via the fluid control path between the reservoir and the chamber. Moving the compression element can apply a force to the elastomeric element. The force applied to the elastomeric element can cause the elastomeric element to expand, thereby sealing the wellbore.

In some aspects, a downhole assembly can include the packer positioned closer to the well head or rig floor than one or more components of the setting tool. For example, the one or more components of the setting tool can be positioned below the packer or otherwise downhole from the packer. In some aspects, positioning one or more components of the setting tool downhole from the packer can allow the setting tool to release fluid into the well bore without affecting the seal provided by the packer. A packer can be set using the setting tool without using a port to the tubing string. The setting tool can thus avoid using a port from the tubing string to the packer to communicate setting pressure from the tubing string to the packer.

These illustrative examples are given to introduce the reader to the general subject matter discussed here and are not intended to limit the scope of the disclosed concepts. The following sections describe various additional aspects and examples with reference to the drawings in which like numerals indicate like elements, and directional descriptions are used to describe the illustrative aspects. The following sections use directional descriptions such as "above," "below," "upper," "lower," "upward," "downward," "left," "right," "uphole," "downhole," etc. in relation to the illustrative aspects as they are depicted in the figures, the upward direction being toward the top of the corresponding figure and the downward direction being toward the bottom of the corresponding figure, the uphole direction being toward the surface of the well and the downhole direction being toward the toe of the well. Like the illustrative aspects, the numerals and directional descriptions included in the following sections should not be used to limit the present disclosure.

FIG. 1 schematically depicts a well system 100 having a tubing string 112 with a packer-setting tool 116. The well system 100 includes a bore that is a wellbore 102 extending through various earth strata. The wellbore 102 has a substantially vertical section 104 and a substantially horizontal section 106. The substantially vertical section 104 and the substantially horizontal section 106 may include a casing string 108 cemented at an upper portion of the substantially vertical section 104. The substantially horizontal section 106 extends through a hydrocarbon bearing subterranean formation 110.

The tubing string 112 within wellbore 102 extends from the surface to the subterranean formation 110. The tubing string 112 can provide a conduit for formation fluids, such as production fluids produced from the subterranean formation 110, to travel from the substantially horizontal section 106 to the surface. Pressure in the wellbore 102 in the subterranean formation 110 can cause formation fluids, including production fluids such as gas or petroleum, to flow to the surface.

The packer-setting tool 116 can be deployed in the wellbore 102. The packer-setting tool 116 can be attached to and/or positioned along the tubing string 112 adjacent to a packer 118. The packer-setting tool 116 can set a packer 118 along the tubing string 112 in response to a signal received via an electrical control line.

Although FIG. 1 depicts the packer-setting tool 116 in the substantially horizontal section 106, the packer-setting tool 116 can be located, additionally or alternatively, in the substantially vertical section 104. In some aspects, the packer-setting tool 116 can be disposed in simpler wellbores, such as wellbores having only a substantially vertical section. The packer-setting tool 116 can be disposed in open-hole environments, such as is depicted in FIG. 1, or in cased wells.

Figure 2:
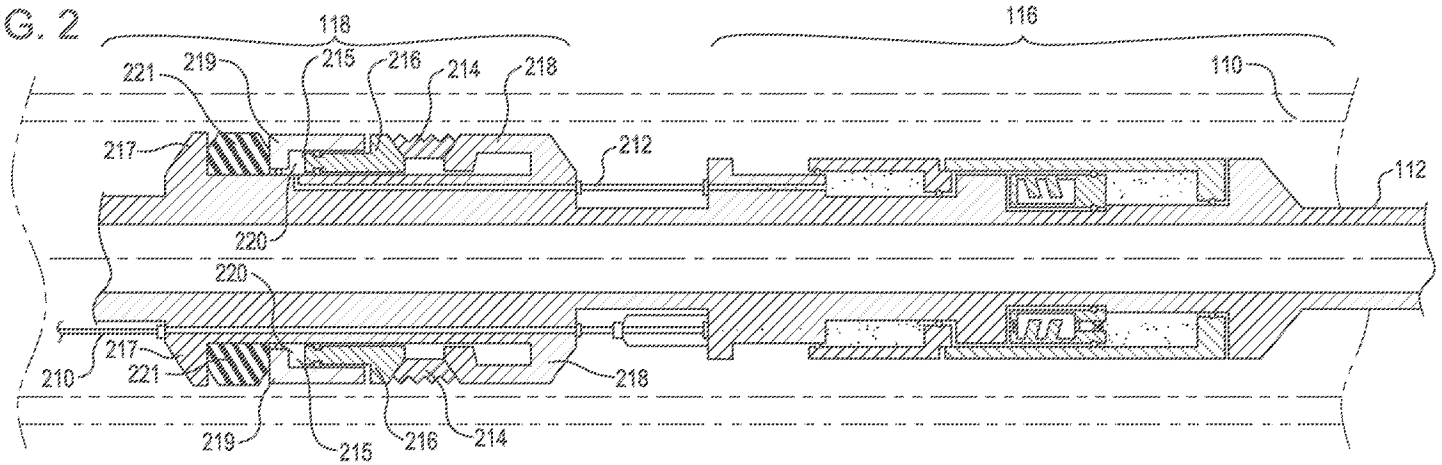
FIG. 2 is a lateral cross-sectional view of a packer and an example of a packer-setting tool utilizing an electrical control line according to one aspect of the present disclosure.

FIG. 2 is a lateral cross-sectional view of a packer 118 and an example of a packer-setting tool 116 utilizing an electrical control line 210. The packer 118 can be linked or otherwise coupled to the packer-setting tool 116 via a fluid control path 212. The packer-setting tool 116 can be linked or otherwise coupled to an electrical control line 210.

The packer 118 can include a slip 214, a first slip ramp 216, a second slip ramp 218, a first compression element 219, a second compression element 217, an elastomeric element 221, and a chamber 220. The first slip ramp 216 can be positioned adjacent to the chamber 220. The slip 214 can be positioned between the first slip ramp 216 and the second slip ramp 218. The first compression element 219 can be positioned adjacent to the chamber 220. The elastomeric element 221 can be positioned between the first compression element 219 and the second compression element 217.

The chamber 220 can include control fluid 215. Control fluid 215 can be any fluid that can communicate a pressure change from one part of the fluid to another part of the fluid. A non-limiting example of the control fluid 215 is a hydraulic fluid. Other non-limiting examples of control fluids 215 include water, oil, transmission fluid, silicone-based fluid, gels, and compressible liquids. The control fluid 215 can be in fluid communication with the fluid control path 212. Although the fluid control path 212 is depicted in FIG. 2 and subsequent figures as a control line, other implementations are possible. In additional or alternative aspects, the fluid control path 212 can be tubing or a long drilled hole in a mandrel.

Figure 3:
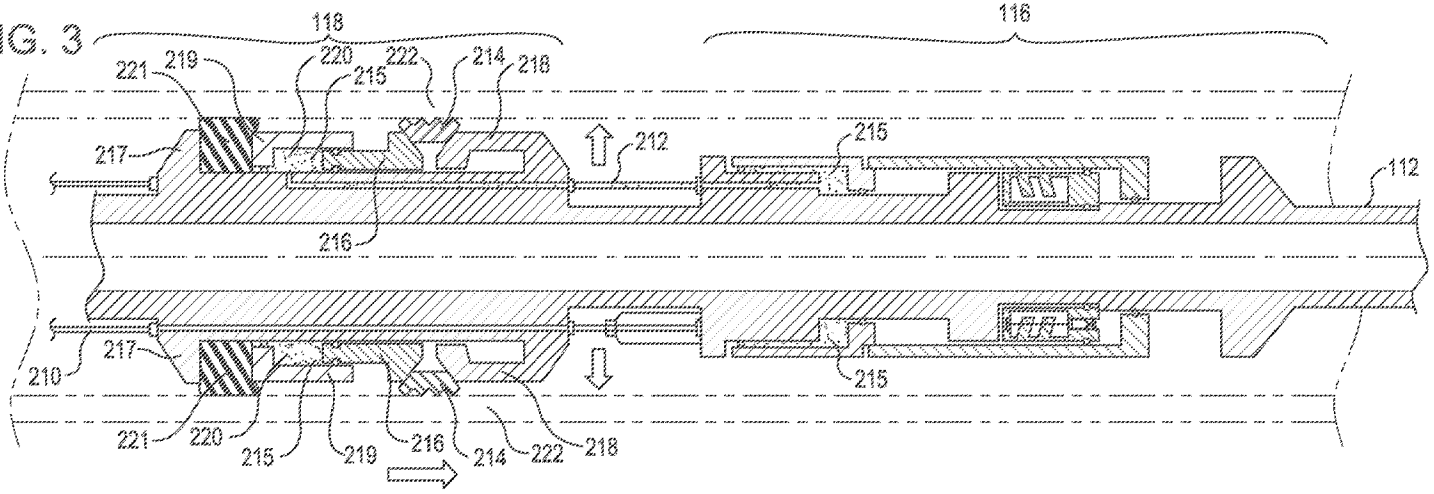
FIG. 3 is a lateral cross-sectional view of the packer as set by the packer-setting tool of FIG. 2 according to one aspect of the present disclosure.

FIG. 3 is a lateral cross-sectional view of the packer 118 as set by the packer-setting tool 116 utilizing an electrical control line 210. The packer-setting tool 116 can be electrically coupled to the electrical control line 210. The packer-setting tool 116 can receive one or more electrical signals via the electrical control line 210. The packer-setting tool 116 can cause control fluid 215 to flow through the fluid control path 212 in response to the electrical signal received via the electrical control line 210.

Although FIG. 3 depicts the packer-setting tool 116 setting a packer 118, the packer-setting tool 116 can be used for other applications. For example, the flow of control fluid 215 through the fluid control path 212 can move a sliding sleeve, move a valve, or otherwise actuate a downhole tool.

Communicating control fluid 215 through the fluid control path 212 can change a pressure of the control fluid 215 in the chamber 220. Changing a pressure of the control fluid 215 in the chamber 220 can cause the control fluid 215 to exert a force on the first slip ramp 216. The force exerted on the first slip ramp 216 can cause the first slip ramp 216 to move toward the second slip ramp 218. For example, as depicted in FIG. 3, control fluid 215 may be communicated through the fluid control path 212 into the chamber 220 to increase the pressure of the control fluid 215 in the chamber 220. The pressure increase may exert a force on the first slip ramp 216 in the direction of the rightward arrow depicted in FIG. 3.

Movement of the first slip ramp 216 toward the second slip ramp 218 can force the slip 214 to ride up the ramps on the first slip ramp 216 and the second slip ramp 218. Forcing the slip 214 to ride up the ramps can move the slip 214 in the radial direction towards an annular surface 222. The radial direction is depicted by the upward and downward arrows in FIG. 3. In one non-limiting example, the annular surface 222 can correspond to the casing 108 in a cased well. In another non-limiting example, the annular surface 222 can correspond to a wall of the formation 110 in an open-hole environment. The slip 214 can move radially such that the slip 214 contacts the annular surface 222. Contact between the slip 214 and the annular surface 222 can anchor the packer 118 relative to the annular surface 222.

Changing a pressure of the control fluid 215 in the chamber 220 can cause the control fluid 215 to exert a force on the first compression element 219. The force exerted on the first compression element 219 can cause the first compression element 219 to move toward the second compression element 217. For example, as depicted in FIG. 3, control fluid 215 may be communicated through the fluid control path 212 into the chamber 220 to increase the pressure of the control fluid 215 in the chamber 220. The pressure increase may exert a force on the first compression element 219 in a direction opposite the direction depicted by the rightward arrow depicted in FIG. 3.

Movement of the first compression element 219 toward the second compression element 217 can exert a compression force on the elastomeric element 221 positioned between the first compression element 219 and the second compression element 217. The elastomeric element 221 can be compressed axially in response to the compression force. The elastomeric element 221 can expand radially in response to the axial compression. The elastomeric element 221 can expand radially such that the elastomeric element 221 contacts the annular surface 222. Contact between the elastomeric element 221 and the annular surface 222 can isolate a section of the annulus between the annular surface 222 and the tubing 112 on one side of the elastomeric element 221 from a section of the annulus between the annular surface 222 and the tubing 112 on an opposite side of the elastomeric element 221.

Although the packer 118 is depicted in FIGS. 2-3 as being configured for communicating the control fluid 215 into the chamber via the fluid control path 212, other implementations are possible. For example, the packer 118 can be configured such that control fluid 215 is communicated out of the chamber 220 via the fluid control path 212.

Although the pressure change in the chamber 220 is depicted in FIGS. 2-3 as an increase in pressure, the packer 118 can utilize a pressure change that is a decrease in pressure. For example, the packer 118 may be configured so that the first slip ramp 216 is stationary and the second slip ramp 218 is slidable. In this configuration, communicating the control fluid 215 out of the chamber 220 may decrease the pressure of the control fluid 215 in the chamber 220. The pressure decrease may exert a force on the second slip ramp 218 that causes the second slip ramp 218 to move in a direction opposite the direction depicted by the rightward arrow in FIG. 3 and force the slip 214 up the ramps to anchor the packer 118 to the annular surface in a manner similar to the description above with respect to the packer 118 depicted in FIG. 3.

In an additional example, the packer 118 may be configured so that the first compression element 219 is stationary and the second compression element 217 is slidable. In this configuration, communicating the control fluid 215 out of the chamber 220 may decrease the pressure of the control fluid 215 in the chamber 220. The pressure decrease may exert a force on the second compression element 217 that causes the second compression element 217 to move in the direction depicted by the rightward arrow in FIG. 3 and compress the elastomeric element 221. Compression of the elastomeric element 221 may isolate a section of the annulus on one side of the elastomeric element 221 from a section of the annulus on an opposite side of the elastomeric element 221 in a manner similar to the description above with respect to the packer 118 depicted in FIG. 3.

Although the packer 118 is depicted in FIG. 3 with the slip 214 positioned downhole of the elastomeric element 221, other implementations are possible. In additional or alternative aspects, the packer 118 can include other combinations or arrangements of packing elements. In one non-limiting example, the packer 118 includes the slip 214 and no elastomeric element 221. In another non-limiting example, the packer 118 includes the elastomeric element 221 and no slip 214. In a further non-limiting example, the packer 118 includes the slip 214 positioned uphole of the elastomeric element 221.

Figure 4:
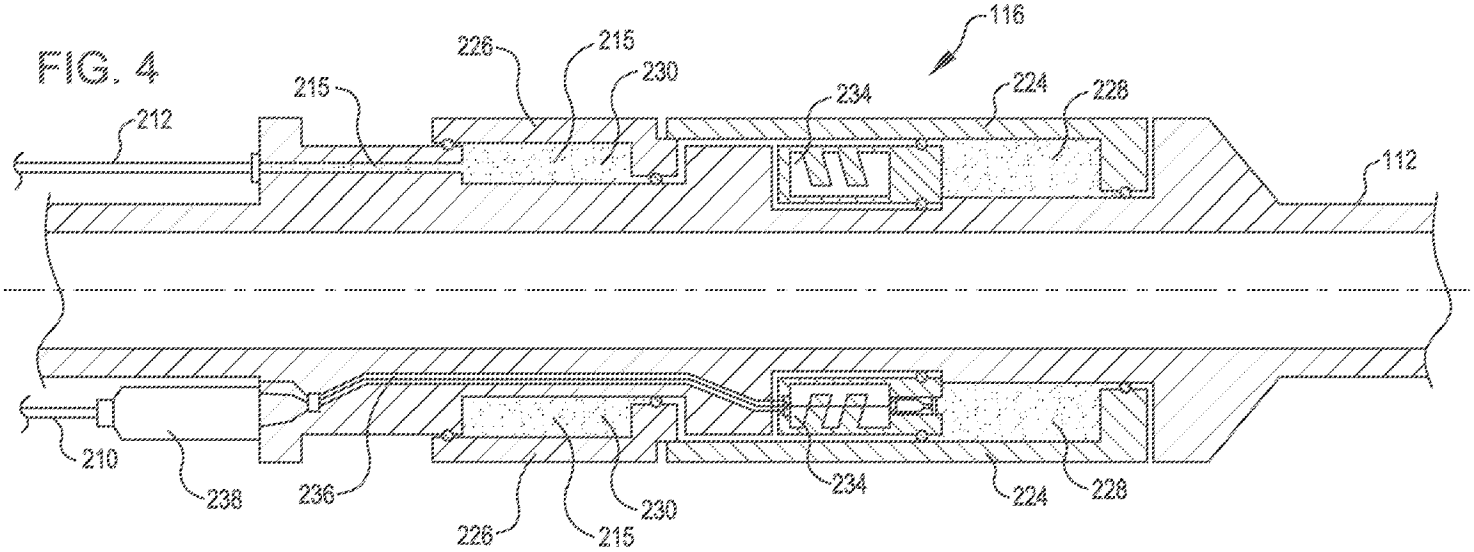
FIG. 4 is a lateral cross-sectional view of the packer-setting tool of FIGS. 2 and 3 according to one aspect of the present disclosure.

FIG. 4 is a lateral cross-sectional view of the packer-setting tool 116 utilizing an electrical control line 210. The packer-setting tool 116 can include a setting sleeve 224, a pressurizing sleeve 226, a setting chamber 228, a reservoir 230, an activation chamber 234, and an electronics package 238.

The reservoir 230 can contain control fluid 215 in fluid communication with the fluid control path 212. The pressurizing sleeve 226 can be positioned adjacent to the reservoir 230 such that movement of the pressurizing sleeve 226 changes a volume of the reservoir 230. Changing the volume of the reservoir 230 can cause the control fluid 215 to flow through the fluid control path 212.

The setting sleeve 224 can be positioned proximate to the pressurizing sleeve 226 such that movement of the setting sleeve 224 causes movement of the pressurizing sleeve 226. The setting sleeve 224 can be positioned adjacent to the setting chamber 228 such that a change in volume of the setting chamber 228 causes movement of the setting sleeve 224.

The setting chamber 228 can be positioned adjacent to the activation chamber 234. The activation chamber 234 can be electrically connected to the electrical control line 210. The electrical connection between the activation chamber 234 and the electrical control line 210 can include a wire 236 and the electronics package 238. The electronics package 238 can transmit an activation signal to the activation chamber 234 via the wire 236 in response to a signal received via the electrical control line 210. Although FIG. 4 depicts a wire 236 providing an electrical connection between the electronics package 238 and the activation chamber 234, other implementations are possible. In some aspects, the wire 236 can be omitted. Any suitable mechanism can be used to provide an electrical connection between the electronics package 238 and the activation chamber 234.

Figure 5:
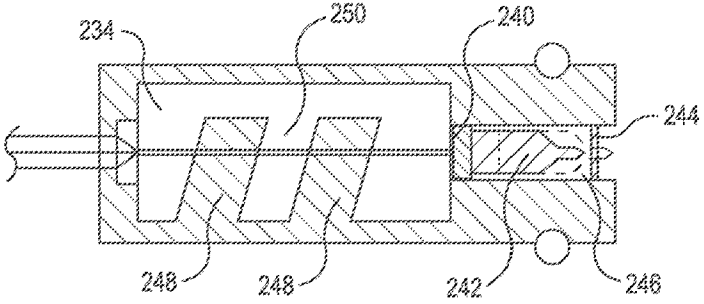
FIG. 5 is a lateral cross-sectional view of an activation chamber of the packer-setting tool of FIGS. 2-4 according to one aspect of the present disclosure.

FIG. 5 is a lateral cross-sectional view of an activation chamber 234 of the packer-setting tool 116 utilizing an electrical control line 210. The activation chamber 234 can include a wire 250, a pyrotechnic charge 240, a puncture tool 242, a rupture disk 244, and an inlet 246. The inlet 246 can be positioned adjacent to the setting chamber 228. The rupture disk 244 can be positioned proximate to or within the inlet 246. The puncture tool 242 can be positioned proximate to the rupture disk 244. The pyrotechnic charge 240 can be positioned proximate to the puncture tool 242. The wire 250 can provide an electrical connection between the pyrotechnic charge 240 and the electrical control line 210.

Positioning the rupture disk 244 proximate to or within the inlet 246 can seal the inlet 246. Sealing the inlet 246 can prevent fluid communication via the inlet 246 from the setting chamber 228 to the activation chamber 234. Sealing the inlet 246 can also maintain a pressure level within the activation chamber 234. In one non-limiting example, the activation chamber 234 can be maintained at atmospheric pressure. In another non-limiting example, the activation chamber 234 can be maintained at a vacuum pressure.

Maintaining the activation chamber 234 at a pressure level can cause the activation chamber 234 to have a pressure that is different from a pressure exerted on the packer-setting tool 116 within the wellbore 102. The difference between the pressure in the well bore 102 and the pressure in the activation chamber 234 can exert a force on the activation chamber 234. The activation chamber can include structure 248 to reinforce the activation chamber 234 such that the force exerted by the pressure difference is prevented from causing the activation chamber 234 to collapse. The structure 248 can allow fluid to flow throughout the activation chamber 234. In one non-limiting example, the structure 248 can be helical in shape.

Figure 6:
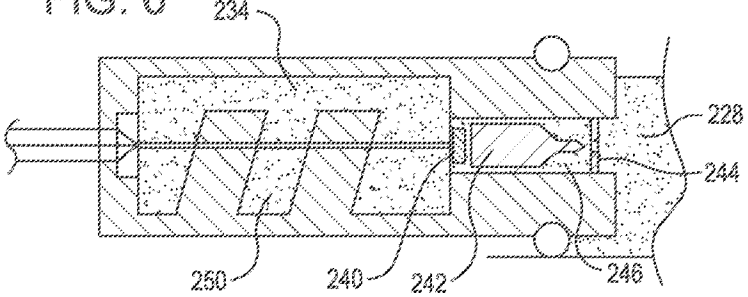
FIG. 6 is a lateral cross-sectional view of the activation chamber of FIG. 5 activated utilizing an electrical control line according to one aspect of the present disclosure.

FIG. 6 is a lateral cross-sectional view of the activation chamber 234 of the packer-setting tool 116 activated utilizing an electrical control line 210. As depicted in FIG. 6, an activation signal can be transmitted via the wire 250 to the pyrotechnic charge 240. The activation signal can detonate the pyrotechnic charge 240. Detonation of the pyrotechnic charge 240 can exert a force on the puncture tool 242. The force exerted on the puncture tool 242 can move the puncture tool 242 into contact with the rupture disk 244. Contact between the puncture tool 242 and the rupture disk 244 can rupture the rupture disk 244. Rupturing the rupture disk 244 can allow fluid communication from the setting chamber 228 to the activation chamber 234 via the inlet 246.

Figure 7:
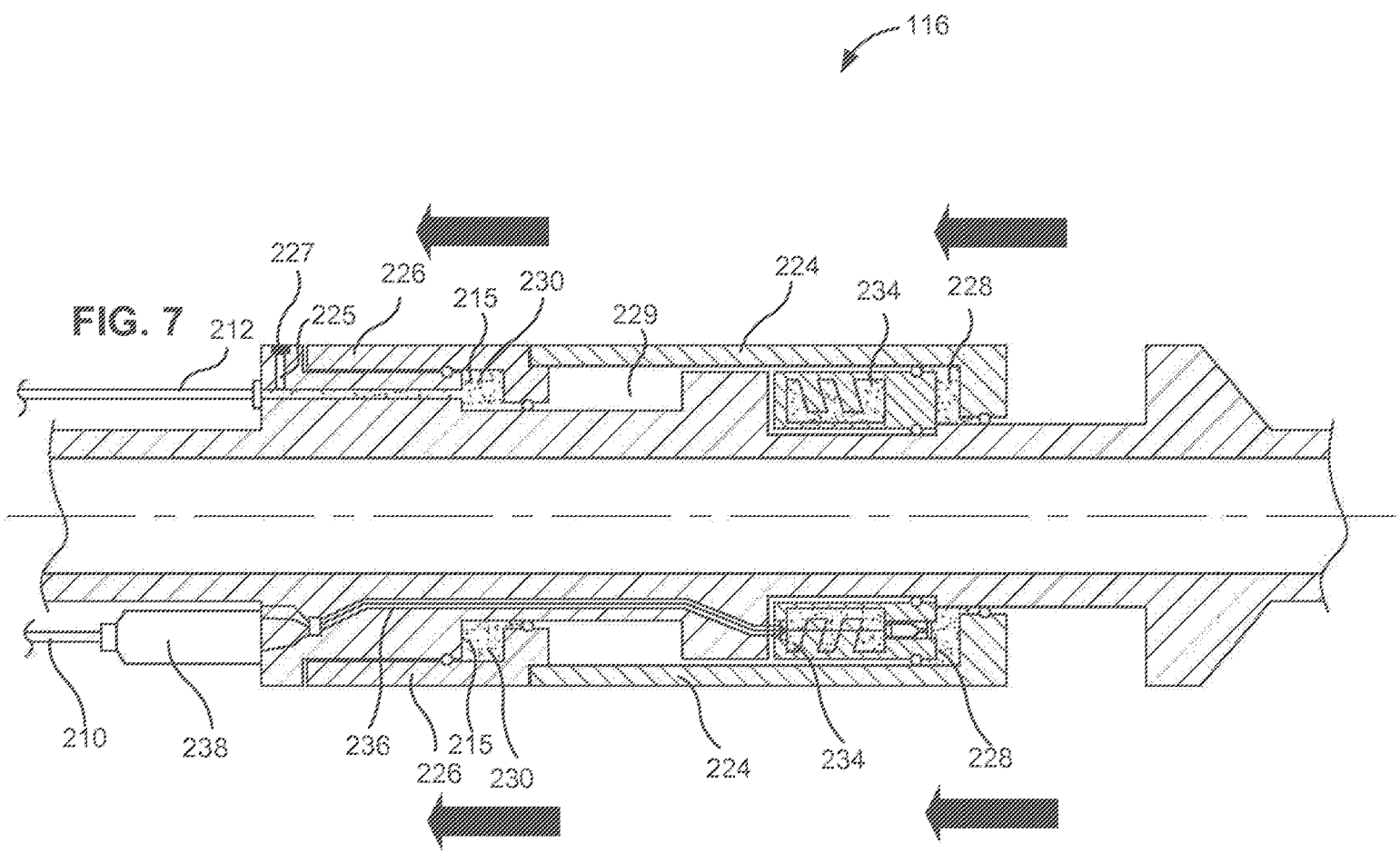
FIG. 7 is a lateral cross-sectional view of the packer-setting tool of FIGS. 2-5 actuated utilizing an electrical control line according to one aspect of the present disclosure.

FIG. 7 is a lateral cross-sectional view of the packer-setting tool 116 actuated utilizing an electrical control line 210. The packer-setting tool 116 can be actuated by an activation signal transmitted via the electrical control line 210 to the activation chamber 234. The activation signal may be transmitted by the electronics package 238. As discussed above with respect to FIG. 6, the activation chamber 234 can allow fluid communication from the setting chamber 228 into the activation chamber 234 in response to the activation signal. Fluid communication from the setting chamber 228 to the activation chamber 234 can change the volume of the setting chamber 228. Changing the volume of the setting chamber 228 can change a pressure within the setting chamber 228. Changing a pressure within the setting chamber can exert a corresponding force on the setting sleeve 224. The force exerted on the setting sleeve 224 can move the setting sleeve 224. As depicted by the leftward arrows in FIG. 7, the force exerted on the setting sleeve 224 can cause the setting sleeve 224 to move. In additional or alternative aspects, a hydrostatic pressure in wellbore 102 can exert a hydrostatic force on the setting sleeve 224. The hydrostatic force exerted on the setting sleeve 224 can move the setting sleeve 224. Movement of the setting sleeve 224 can move the pressurizing sleeve 226. Movement of the pressurizing sleeve 226 can change the volume of the reservoir 230. Changing the volume of the reservoir 230 can cause control fluid 215 to flow through the fluid control path 212. Flow of control fluid 215 through the fluid control path 212 can set the packer 118, as discussed above with respect to FIG. 3.

In some aspects, the packer setting tool 116 can include a venting port 225 and a sealing element 227. The venting port 225 can be in fluid communication with the reservoir 230 to provide a flow path from the reservoir 230 into the wellbore 102. The sealing element 227 can be positioned within or adjacent to the venting port 225 such that fluid communication from the reservoir 230 to the wellbore 102 is prevented. Non-limiting examples of the sealing element 227 include a rupture disk and a dump valve. After the packer 118 has been set as discussed above with respect to FIG. 3, the pressure of the fluid in the reservoir 230 may continue to increase. The sealing element 227 can be modified in response to the increase in pressure in the reservoir 230 such that fluid communication from the reservoir 230 to the wellbore 102 is allowed. For example, the increased pressure may open a sealing element 227 such as a dump valve or rupture a sealing element 227 such as a rupture disk to allow fluid communication from the reservoir 230 to the wellbore 102. Allowing fluid communication from the reservoir 230 to the wellbore 102 via the venting port 225 can relieve the pressure in the reservoir 230 and prevent damage to the system. The packer setting tool 116 may vent or lose control fluid without affecting the seal of the packer 118 in the wellbore 102. In other aspects, the venting port 225 and the sealing element 227 can be omitted.

Although the packer-setting tool 116 is depicted in FIG. 7 as being configured to communicate control fluid 215 out of the reservoir 230 into the fluid control path 212, other implementations are possible. In some aspects, the packer-setting tool 116 can be configured such that control fluid 215 is communicated into the reservoir 230 via the fluid control path 212.

Although FIG. 7 depicts various volume changes as decreases in volume, other implementation are possible. In some aspects, the packer-setting tool 116 can utilize volume changes that are increases in volume. For example, the packer-setting tool 116 may include a reservoir 230 positioned at an alternate position 229 relative to the pressurizing sleeve 226 such that movement of the pressurizing sleeve 226 will increase the volume of the reservoir 230. Increasing the volume of the reservoir 230 may communicate control fluid 215 from the fluid control path 212 into the reservoir 230.

Figure 8:
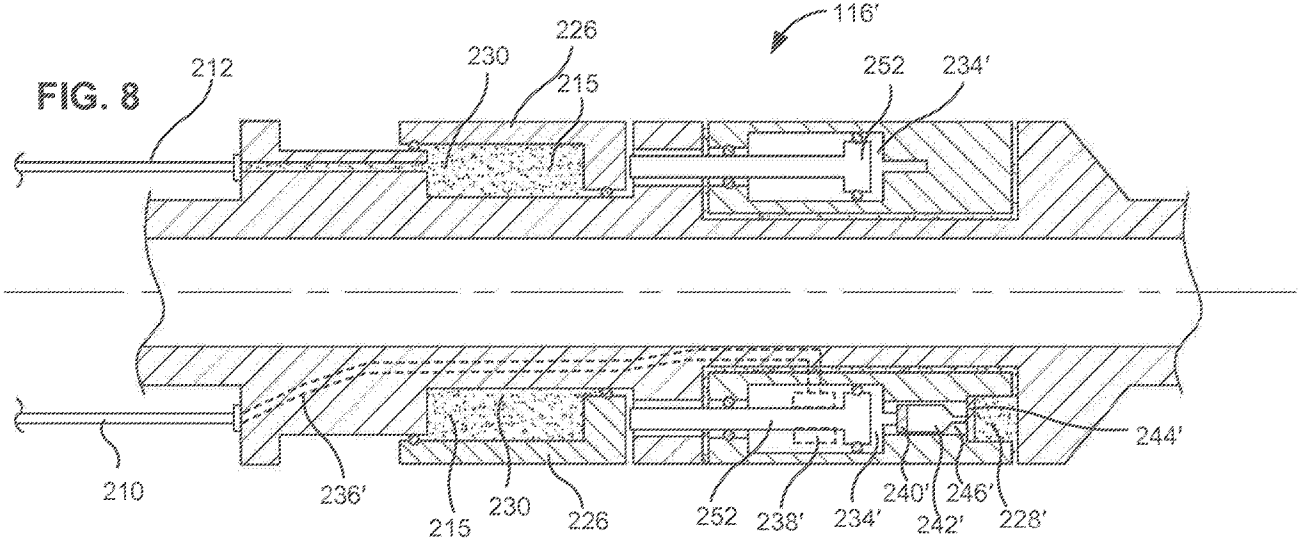
FIG. 8 is a lateral cross-sectional view of another example of a packer-setting tool utilizing an electrical control line according to one aspect of the present disclosure.

FIG. 8 is a lateral cross-sectional view of an alternate packer-setting tool 116' utilizing an electrical control line 210. The packer-setting tool 116' can include at least one setting piston 252, a pressurizing sleeve 226, a setting chamber 228', a reservoir 230, an activation chamber 234', and an electronics package 238'.

The reservoir 230 can contain control fluid 215 in fluid communication with a fluid control path 212. The fluid control path 212 can communicate control fluid 215 to actuate a downhole tool. In one non-limiting example, the downhole tool is a packer 118. In another non-limiting example, the downhole tool is a sliding sleeve. In another non-limiting example, the downhole tool is a valve.

The pressurizing sleeve 226 can be positioned adjacent to the reservoir 230 such that movement of the pressurizing sleeve 226 can change a volume of the reservoir 230. Changing the volume of the reservoir 230 can cause control fluid 215 to flow through the fluid control path 212.

The setting piston 252 can be positioned proximate to the pressurizing sleeve 226 such that movement of the setting piston 252 can cause movement of the pressurizing sleeve 226. The setting piston 252 can be positioned at least partially within the activation chamber 234'. Although a single setting piston 252 is described herein for illustrative purposes, a packer-setting tool 116' can utilize multiple setting pistons. For example, a packer-setting tool 116' having at least two setting pistons 252 is depicted in FIG. 8. Although two setting pistons 252 are depicted in FIG. 8, any number of setting pistons 252 may be utilized.

The setting chamber 228' can be in fluid communication with an annulus between the packer-setting tool 116' and the well bore 102. Fluid communication between the annulus and the setting chamber 228' can cause a pressure in the setting chamber 228' to be approximately equal to a pressure in the annulus. The setting chamber 228' can be positioned adjacent to the activation chamber 234'.

One or more components for actuating the packer-setting tool 116' can be disposed in the activation chamber 234'. As depicted in FIG. 8, a pyrotechnic charge 240', a puncture tool 242', a rupture disk 244', and an inlet 246' can be disposed in the activation chamber 234'. The pyrotechnic charge 240' can be electrically connected to the electrical control line 210. The electrical connection between the pyrotechnic charge 240' and the electrical control line 210 can include the electronics package 238'. The electronics package can be positioned within the activation chamber 234'. The electronics package 238' can transmit an activation signal to the activation chamber 234' in response to a signal received via the electrical control line 210. The electrical connection between the pyrotechnic charge 240' and the electrical control line 210 can include a wire 236.

The pyrotechnic charge 240' can be positioned proximate to the puncture tool 242'. The puncture tool 242' can be positioned proximate to the rupture disk 244'. The rupture disk 244' can be positioned proximate to, or within, the inlet 246'. The inlet 246' can be positioned adjacent to the setting chamber 228'.

Positioning the rupture disk 244' proximate to or within the inlet 246' can seal the inlet 246'. Sealing the inlet 246' can prevent fluid communication via the inlet 246' from the setting chamber 228' to the activation chamber 234'. Sealing the inlet 246' can also maintain a pressure level within the activation chamber 234'. The setting piston 252 can perform one or more functions similar to the description with respect to FIG. 5 above. The setting piston 252 can reinforce the activation chamber 234' such that a force exerted by a pressure difference between a pressure in the activation chamber and a pressure in the tubing 112 is prevented from causing the activation chamber 234 to collapse.

Figure 9:
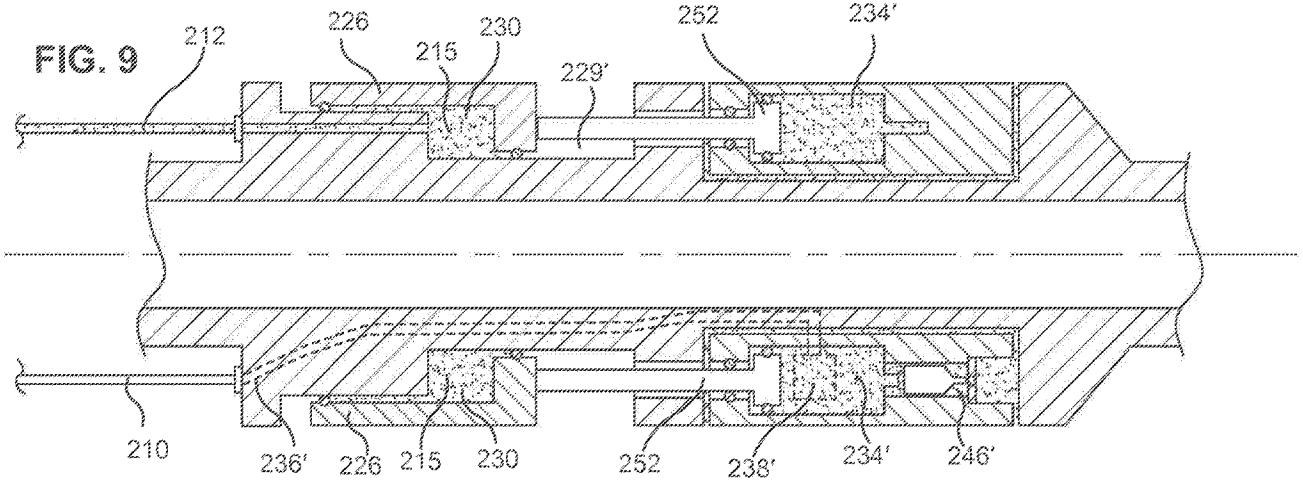
FIG. 9 is a lateral cross-sectional view of the packer-setting tool of FIG. 8 actuated utilizing an electrical control line according to one aspect of the present disclosure.

FIG. 9 is a lateral cross-sectional view of the alternate packer-setting tool 116' actuated utilizing an electrical control line 210. As depicted in FIG. 9, an activation signal can be transmitted via the electrical control line 210 to the pyrotechnic charge 240'. The activation signal can be transmitted via the electronics package 238'. The activation signal can detonate the pyrotechnic charge 240'. Detonation of the pyrotechnic charge 240' can exert a force on the puncture tool 242'. The force exerted on the puncture tool 242' can move the puncture tool 242' into contact with the rupture disk 244'. Contact between the puncture tool 242' and the rupture disk 244' can rupture the rupture disk 244'. Rupturing the rupture disk 244' can allow fluid communication via the inlet 246' from the setting chamber 228' into the activation chamber 234'.

Fluid communication from the setting chamber 228' to the activation chamber 234' can allow the activation chamber 234' to fill with fluid from the setting chamber 228'. In one non-limiting example, the fluid filling the activation chamber 234' can contact the electronics package 238'. The fluid filling the activation chamber 234' can exert a force on at least one setting piston 252. As depicted by the leftward arrows in FIG. 9, exerting a force on the setting piston 252 can cause the setting piston 252 to move. Movement of the setting piston 252 can cause the setting piston 252 to contact the pressurizing sleeve 226 such that movement of the setting piston 252 causes the pressurizing sleeve 226 to move. Movement of the pressurizing sleeve 226 can change the volume of the reservoir 230. Changing the volume of the reservoir 230 can cause control fluid 215 to flow through the fluid control path 212. Flow of control fluid 215 through the fluid control path 212 can actuate a downhole tool positioned in the tubing 112.

Although the packer-setting tool 116' is depicted in FIGS. 8-9 as being configurable to communicate control fluid 215 out of the reservoir 230 into the fluid control path 212, other implementations are possible. In some aspects, the packer-setting tool 116' can be configured such that control fluid 215 is communicated into the reservoir 230 via the fluid control path 212.

Although FIGS. 8-9 depict various volume changes as decreases in volume, other implementations are possible. In some aspects, the packer-setting tool 116' can utilize volume changes that are associated with increases in volume. For example, the packer-setting tool 116' may include a reservoir 230 positioned at an alternate position 229' relative to the pressurizing sleeve 226 such that movement of the pressurizing sleeve 226 will increase the volume of the reservoir 230. Increasing the volume of the reservoir 230 may communicate control fluid 215 from the fluid control path 212 into the reservoir 230.

Figure 10:
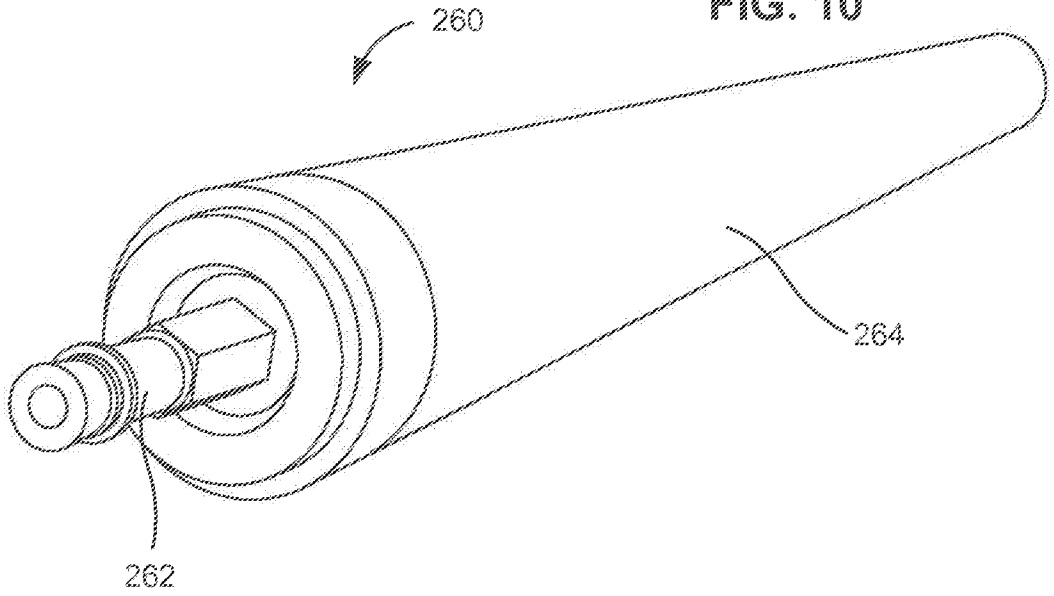
FIG. 10 is a perspective view of an electric actuator of a further example of a packer-setting tool utilizing an electrical control line according to one aspect of the present disclosure.

FIG. 10 is a perspective view of an electric actuator 260 of an additional alternate packer-setting tool 116" utilizing an electrical control line 210. The electric actuator 260 can include a rod 262 and a body 264. The rod 262 can be housed at least partially within the body 264. The rod 262 can extend from the body 264 in response to an electrical signal received by the electric actuator 260.

Figure 11:
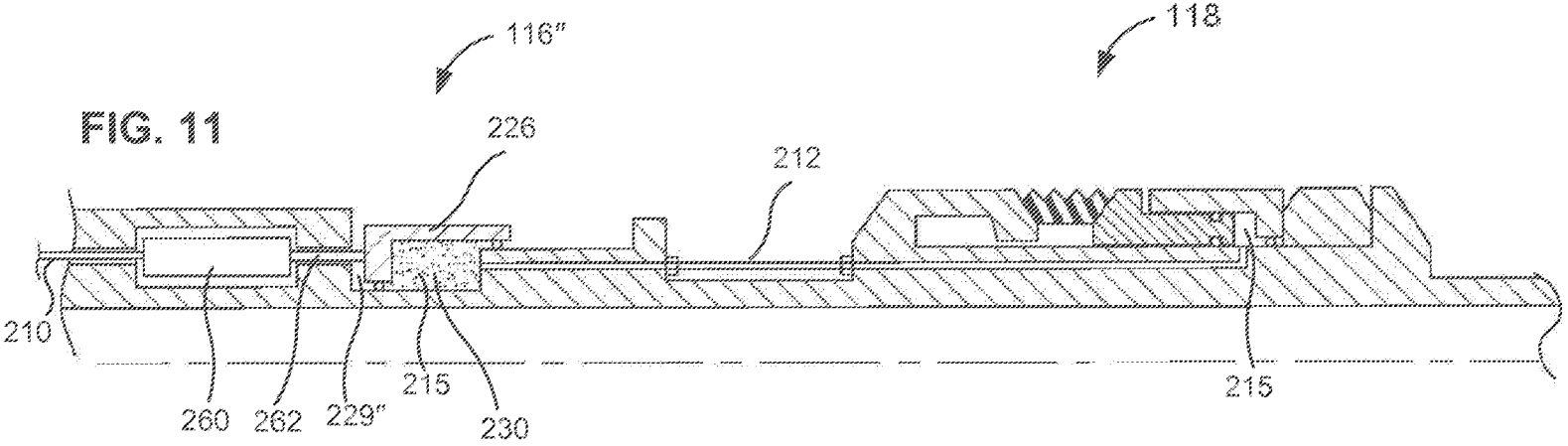
FIG. 11 is a lateral cross-sectional view of a packer-setting tool utilizing the electric actuator of FIG. 10 according to one aspect of the present disclosure.

FIG. 11 is a lateral cross-sectional view of the additional alternate packer-setting tool 116" utilizing an electrical control line 210. The packer-setting tool 116" can include an electric actuator 260, a pressurizing sleeve 226, a reservoir 230, and a fluid control path 212.

The reservoir 230 can contain control fluid 215 in fluid communication with a fluid control path 212. The fluid control path 212 can communicate control fluid 215 to set the packer 118 and/or actuate a downhole tool.

The pressurizing sleeve 226 can be positioned adjacent to the reservoir 230. Movement of the pressurizing sleeve 226 can change a volume of the reservoir 230. Changing the volume of the reservoir 230 can cause control fluid 215 to flow through the fluid control path 212.

The rod 262 can be positioned adjacent to the pressurizing sleeve 226. Actuation of the electric actuator 260 can move the rod 262. The electric actuator 260 can be electrically coupled to the electrical control line 210.

An activation signal can be transmitted to the electric actuator 260 via the electrical control line 210. The activation signal can cause the electric actuator 260 to actuate. Actuation of the electric actuator 260 can cause the rod 268 to move. Movement of the rod 268 can cause the rod 268 to contact the pressurizing sleeve 226 such that movement of the rod 268 can cause the pressurizing sleeve 226 to move. Movement of the pressurizing sleeve 226 can change the volume of the reservoir 230. Changing the volume of the reservoir 230 can cause control fluid 215 to flow through the fluid control path 212. Flow of control fluid 215 through the fluid control path 212 can set the packer 118 in the manner similar to the manner of setting the packer 118 described above with respect to FIG. 3. In some aspects, the actuator 260 can be a screw drive configured for providing incremental steps forward or backward to control the fluid pressure.

Although FIG. 11 depicts the packer-setting tool 116" setting a packer 118, the packer-setting tool 116" can be used for other applications. In additional or alternative aspects, the flow of control fluid 215 through the fluid control path 212 can move a sliding sleeve, move a valve, or otherwise actuate a downhole tool.

Although the packer-setting tool 116" is depicted in FIG. 11 as being configured to communicate control fluid 215 out of the reservoir 230 into the fluid control path 212, other implementations are possible. In some aspects, the packer-setting tool 116" can be configured such that control fluid 215 is communicated into the reservoir 230 via the fluid control path 212.

Although FIG. 11 depicts various volume changes as decreases in volume, other implementations are possible. In some aspects, the packer-setting tool 116" can utilize volume changes that are increases in volume. For example, the packer-setting tool 116" may include a reservoir 230 positioned at an alternate position 229" relative to the pressurizing sleeve 226 such that movement of the pressurizing sleeve 226 will increase the volume of the reservoir 230. Increasing the volume of the reservoir 230 may communicate control fluid 215 from the fluid control path 212 into the reservoir 230. In some aspects, the electric actuator 260 can be operated to selectively change the direction of flow of the control fluid 215 via the fluid control path 212. For example, the electric actuator 260 may extend rod 262 to cause control fluid 215 to flow in a first direction and may retract rod 262 to cause control fluid 215 to flow in an opposite direction. Selectively changing the direction of flow can provide greater control over downhole tools. For example, a ball valve may be closed by moving control fluid 215 in a first direction via the fluid control path and re-opened by reversing the direction of flow.

Figure 12:
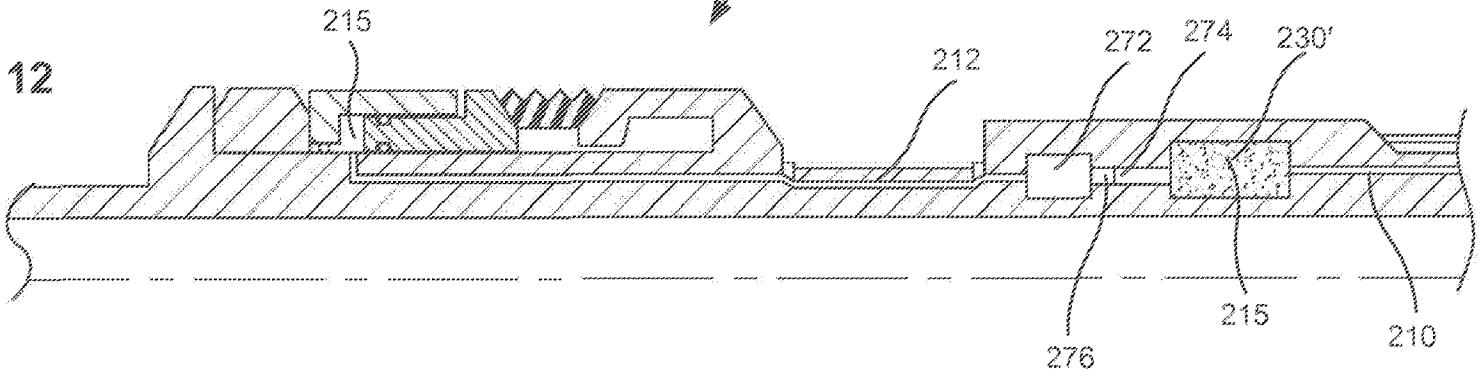
FIG. 12 is a lateral cross-sectional view of another example of a packer-setting tool utilizing an electrical control line according to one aspect of the present disclosure.

FIG. 12 is a lateral cross-sectional view of another alternate packer-setting tool 116'" utilizing an electrical control line 210. Packer-setting tool 116'" can include a reservoir 230' and a pump 272.

The pump 272 can be in fluid communication with the reservoir 230'. The pump 272 can be electrically coupled to the electrical control line 210. A signal can be transmitted via the electrical control line 210 to the pump 272. The pump 272 can activate in response to the signal. Activation of the pump 272 can pressurize control fluid 215 from the reservoir 230' such that the control fluid 215 flows through the fluid control path 212. The flow of the control fluid 215 through the fluid control path 212 can set the packer 118 in the manner similar to the manner of setting the packer 118 described above with respect to FIG. 3.

Although FIG. 12 depicts the packer-setting tool 116'" setting a packer 118, the packer-setting tool 116'" can be used for other applications. In additional or alternative aspects, the flow of control fluid 215 through the fluid control path 212 can move a sliding sleeve, move a valve, or otherwise actuate a downhole tool.

Although the packer-setting tool 116" is depicted in FIG. 12 as being configured for communicating control fluid 215 out of the reservoir 230' into the fluid control path 212, other implementations are possible. In some aspects, the packer-setting tool 116" can be configured such that control fluid 215 is communicated into the reservoir 230' via the fluid control path 212. For example, the packer-setting tool 116'" may include a pump 272 configured to generate a pressure such that control fluid 215 is communicated from the fluid control path 212 into the reservoir 230'. In some aspects, the pump 272 can be operated to selectively change the direction of flow of the control fluid 215 via the fluid control path 212. For example, the pump may pump control fluid 215 in a first direction and reverse operation to pump the control fluid 215 in the opposite direction. Selectively changing the direction of flow can provide greater control over downhole tools. For example, a ball valve may be closed by pumping control fluid 215 in a first direction via the fluid control path and may be re-opened by reversing the direction of flow.

The packer-setting tool 116'" can also include a controller 274. The electrical connection between the pump 272 and the electrical control line 210 can include the controller 274.

The controller 274 can receive the signal communicated via the electrical control line 210. The controller 274 can control operation of the pump 272. In some aspects, the controller 274 can control operation of the pump 272 automatically. Controlling operation of the pump 272 automatically can include operating the pump 272 independently of control signals communicated via the electrical control line 210. In additional or alternative aspects, the controller 274 can control operation of the pump 272 based at least in part on the signal communicated via the electrical control line 210. In one non-limiting example, a tool operator at the surface of the well system 100 may operate the controller 274 by sending signals via the electrical control line 210.

The packer-setting tool 116''' can also include a transducer 276. The transducer 276 can be responsive to fluid pressure. The transducer 276 can produce a signal that varies according to variations in fluid pressure. The transducer 276 signal can be utilized as a measurement of fluid pressure. The transducer 276 can be positioned in fluid communication with the pump 272 such that the transducer is responsive to the fluid pressure of fluid pressurized by the pump 272. The transducer 276 signal can indicate a pressure level of fluid pressurized by the pump 272.

The controller 274 can control the operation of the pump 272 at least in part based on one or more feedback signals including pressure information. The pressure information may indicate a pressure level of fluid pressurized by the pump 272. In one aspect, the transducer 276 can provide pressure information. In additional or alternative aspects, pressure information can be provided based at least in part on a voltage applied to the pump 272. In one aspect, the controller 274 can automatically control the pump 272 based on the pressure information. Automatically controlling the pump 272 based on the pressure information can include increasing or decreasing the pressurization provided by the pump 272 independently of control signals received from the surface via the electrical control line 210. In additional or alternative aspects, the controller 274 can communicate one or more feedback signals including pressure information via the electrical control line 210 to an operator at the surface of the well system 100. For example, the controller 274 may communicate pressure information from the transducer 276, the voltage applied to the pump 272, or some combination thereof to a control unit at the surface operated by the operator. The operator may operate the controller 274 based at least in part upon the pressure information from the transducer 276 or from the voltage applied to the pump 272 or both. The operator can operate the controller 274 by transmitting control signals to the controller via the electrical control line 210.

Figure 13:
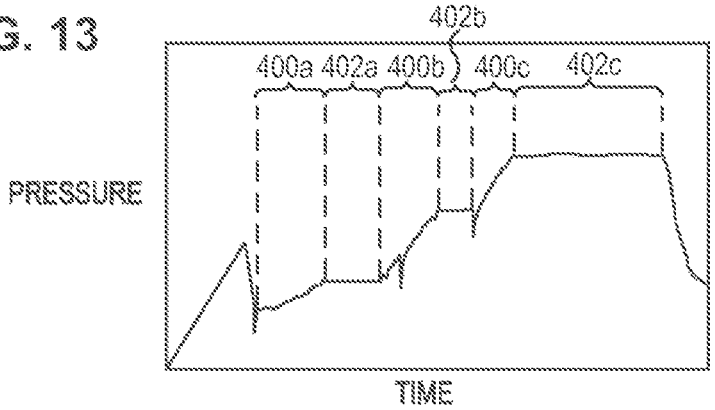
FIG. 13 is a chart depicting a graphical representation of an example of a feedback signal indicating setting of a packer according to one aspect of the present disclosure.

In some aspects, the feedback signal including pressure information can be utilized to monitor the performance of the packer-setting tool 116''' positioned in the wellbore 102. For example, FIG. 13 is a chart depicting a graphical representation of an example of a feedback signal indicating successful setting of a packer. A packer-setting process may include a scripted sequence of pressure increases between set pressures and holds at the set pressures. As depicted in FIG. 13, a number of gradually increasing regions 400*a-c* in the feedback signal can indicate successful transitions between set pressures. Interspersed level regions 402*a-c* in the feedback signal can indicate successful maintenance of set pressures.

Figure 14:
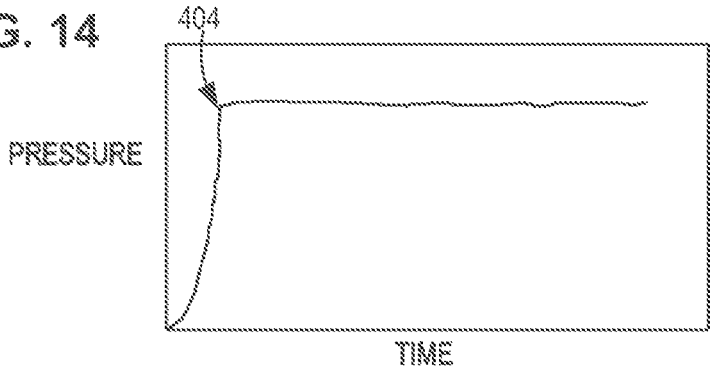
FIG. 14 is a chart depicting a graphical representation of an example of a feedback signal indicating unsuccessful setting of a packer according to one aspect of the present disclosure.

FIG. 14 is a chart depicting a graphical representation of an example of a feedback signal indicating unsuccessful setting of a packer. As depicted in FIG. 14, immediate high pressure 404 in the feedback signal may indicate a plugged fluid control path 212, malfunctioning valve, and/or a pump 272 failure. Such a feedback signal pattern may indicate that the packer has not started the setting process.

Figure 15:
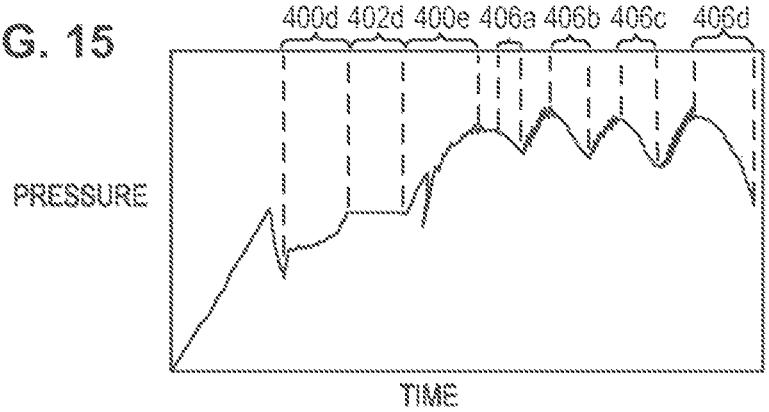
FIG. 15 is a chart depicting a graphical representation of an example of a feedback signal indicating a leak during setting of a packer according to one aspect of the present disclosure.

FIG. 15 is a chart depicting a graphical representation of an example of a feedback signal indicating a leak during packer setting. As depicted in FIG. 13, one or more gradually increasing regions 400*d-e* in the feedback signal can indicate successful transitions between set pressures. One or more level regions 402*d* in the feedback signal can indicate successful maintenance of set pressures. Drops 406*a-d* in pressure from a set pressure can indicate a leak allowing the losses in pressure.

In some aspects, a downhole assembly for a wellbore can be provided. The downhole assembly can comprise a reservoir containing a control fluid, the control fluid in communication with a fluid control path of a downhole tool and a pressurizing module electrically coupleable to an electrical control line and operable for applying a pressure change to the control fluid, wherein at least a quantity of the control fluid is transmittable via the fluid control path for actuation of the downhole tool, wherein the quantity of the control fluid is controllable by a pressure change applied to the control fluid by the pressurizing module in response to an activation signal received via the electrical control line.

In additional or alternative aspects, the pressurizing module of the downhole assembly can comprise a pump. In some aspects, the pump is operable for selectively changing the direction of flow of the control fluid via the fluid control path. In some aspects, the pump is operable for pumping control fluid in a first direction and operable for reversing operation for pumping the control fluid in an opposite direction. In some aspects, the pump is operable to provide a variable flow of control fluid for providing a variable force for variable actuation of the downhole tool.

In additional or alternative aspects, the pressurizing module of the downhole assembly can comprise an electric actuator. In some aspects, the actuator is operable for selectively changing the direction of flow of the control fluid via the fluid control path. In some aspects, the actuator is operable for driving control fluid in a first direction, and operable for reversing operation for driving the control fluid in an opposite direction. In some aspects, the actuator is operable to provide a variable flow of control fluid for providing a variable force for variable actuation of the downhole tool.

In additional or alternative aspects, the pressurizing module of the downhole assembly can comprise a controller, wherein the controller is operable for receiving the activation signal and actuating the pressurizing module in response to the received activation signal. In some aspects, the controller is operable for controlling the pressurizing module based at least in part upon a voltage level applied to the pressurizing module. In some aspects, the pressurizing module further can comprise a pressure transducer, wherein the pressure transducer is operable for measuring a pressure of the control fluid, wherein the controller is operable for controlling the pressurizing module based at least in part upon a pressure reading from the pressure transducer. In some aspects, the controller is operable for identifying a control unit accessible via the electrical control line and for communicating a feedback signal via the electrical control line. In some aspects the controller is operable for recognizing the activation signal from a plurality of signals received via the electrical control line, wherein the activation signal is addressed to the controller and at least one of the plurality of signals is addressed to another downhole tool. In some aspects, the controller is operable for storing data corresponding to the operation of the pressurizing module.

In additional or alternative aspects, the downhole assembly can further comprise a packer. The packer can comprise: a chamber in fluid communication with the fluid control path of the downhole tool; a compression element in fluid communication with the chamber, wherein the compression element is movable in response to communication of the quantity of control fluid via the fluid control path between the reservoir and the chamber; and a packing element adjacent to the compression element and movable in a radial direction relative to the packer in response to a compressive force applied to the packing element by a movement of the compression element.

In additional or alternative aspects, the pressurizing module of the downhole assembly can comprise: a chamber; a rupture disk, wherein the rupture disk is operable for preventing communication of a fluid into the chamber; a puncture tool, wherein the puncture tool is operable for puncturing the rupture disk in response to the activation signal such that communication of the fluid into the chamber is allowed; and a setting element, wherein the setting element is operable for moving in response to the communication of the fluid into the chamber, wherein movement of the setting element is operable for communicating a force to the reservoir, wherein the reservoir is operable for communicating at least the quantity of control fluid via the fluid control path in response to the force communicated by the setting element. In some aspects, the downhole assembly is couplable with a segment of production tubing for actuating the packer without using a port providing fluid communication with a source of internal tubing pressure of the segment of production tubing. In some aspects, the packing element comprises an elastomeric element. In some aspects, the packing element comprises a slip element movable in a radial direction in response to the compression force. In some aspects, the downhole assembly can further comprise a pyrotechnic charge positioned adjacent to the puncture tool, wherein the pyrotechnic charge is operable for detonating in response to receiving the activation signal, wherein the puncture tool is operable for puncturing the rupture disk in response to a detonation of the pyrotechnic charge.

In some aspects, the packer is positionable closer to a well head of the wellbore than the pressurizing module for allowing a release of fluid into the well bore from the pressurizing module without affecting the expansion of the packing element after the packing element has been expanded.

In some aspects, a downhole assembly for a wellbore can be provided. The downhole assembly can comprise: a structure defining a fluid control path containing an amount of control fluid, the fluid control path operable for actuating a downhole tool in response to a pressure change in the fluid control path; a pressurizing module coupled with the fluid control path, wherein the pressurizing module is operable for changing pressure in the fluid control path; and a controller electrically coupled with an electrical control line, wherein the controller is operable for receiving at least one activation signal via the electrical control line and operating the pressurizing module to produce the pressure change in the fluid control path for actuating the downhole tool in response to the at least one activation signal.

In additional or alternative aspects, the downhole assembly can further comprise the downhole tool, wherein the downhole tool comprises a packer. The packer can comprise: a chamber in fluid communication with the fluid control path of the downhole tool; a compression element in fluid communication with the chamber, wherein the compression element is movable in response to communication of the quantity of control fluid via the fluid control path to or from the chamber; and a packing element adjacent to the compression element and expandable in response to a compressive force applied to the packing element by a movement of the compression element. In some aspects, the pressurizing module comprises a pump. In some aspects, the pressurizing module comprises an actuator.

In additional or alternative aspects, the downhole assembly can further comprise a reservoir containing a quantity of control fluid, the quantity of control fluid in communication with the amount of control fluid contained in the fluid control path, wherein the pressurizing module is operable for producing the pressure change by communicating at least some of the quantity of control fluid via the fluid control path between the reservoir and the downhole tool.

In some aspects, a downhole assembly for a wellbore is provided. The downhole assembly can comprise: an electrical control line; a chamber; a rupture disk operable for preventing communication of a fluid into the chamber; a rupturing mechanism operable for rupturing the rupture disk in response to an activation signal received via the electrical control line; a setting element, wherein the setting element is movable in response to the communication of the fluid into the chamber; and a reservoir positioned adjacent to the setting element and containing a control fluid in fluid communication with a fluid control path of a downhole tool, wherein the reservoir is responsive to a force from movement of the setting element by communicating at least some of the control fluid via the fluid control path to actuate the downhole tool in response to the force communicated by the setting element.

In additional or alternative aspects, the downhole tool can comprise at least one of a packer, a sliding sleeve, or a valve. In additional or alternative aspects, the setting element can comprise at least one of a piston or a setting sleeve.

In additional or alternative aspects, the rupturing mechanism can comprise a pyrotechnic charge positioned adjacent to the rupture disk, wherein the pyrotechnic charge is operable for detonating and rupturing the rupture disk in response to the activation signal.

In additional or alternative aspects, the rupturing mechanism can further comprise a pyrotechnic charge positioned adjacent to a puncture tool, wherein the pyrotechnic charge is operable for detonating in response to receiving the activation signal, wherein the puncture tool is operable for puncturing the rupture disk in response to a detonation of the pyrotechnic charge.

The foregoing description, including illustrated aspects and examples, has been presented only for the purpose of illustration and description and is not intended to be exhaustive or limiting to the precise forms disclosed. Numerous modifications, adaptations, and uses thereof will be apparent to those skilled in the art without departing from the scope of this disclosure.

What is claimed is:

1. A downhole assembly for a wellbore, the downhole assembly comprising:

a packer tool;

a reservoir containing a control fluid, the control fluid in communication with a fluid control path of the packer tool; and a pressurizing module electrically coupleable to an electrical control line and operable for applying a plurality of pressure changes to the control fluid, wherein the pressurizing module comprises a pump, and wherein at least a quantity of the control fluid is transmittable via the fluid control path for actuation of the packer tool, wherein the quantity of the control fluid is controllable by the plurality of pressure changes applied to the control fluid by the pressurizing module in response to a plurality of activation signals received via the electrical control line, and wherein an amount of each of the plurality of pressure changes is controlled by a respective activiation signal of the plurality of activiation signals;

wherein the packer tool further comprises:

a first chamber in fluid communication with the fluid control path of the packer tool, a compression element in fluid communication with the first chamber, wherein the compression element is movable in response to communication of the quantity of control fluid via the fluid control path between the reservoir and the first chamber, and a packing element adjacent to the compression element and movable in a radial direction relative to the packer tool in response to a compressive force applied to the packing element by a movement of the compression element.

2. The downhole assembly of claim 1, wherein the pressurizing module further comprises a controller, wherein the controller is operable for receiving the respective activation signal and actuating the pressurizing module in response to the received respective activation signal.

3. The downhole assembly of claim 2, wherein the controller is operable for controlling the pressurizing module based at least in part upon a voltage level applied to the pressurizing module.

4. The downhole assembly of claim 2, wherein the pressurizing module further comprises a pressure transducer, wherein the pressure transducer is operable for measuring a pressure of the control fluid, wherein the controller is operable for controlling the pressurizing module based at least in part upon a pressure reading from the pressure transducer.

5. The downhole assembly of claim 2, wherein the controller is operable for identifying a control unit accessible via the electrical control line and for communicating a feedback signal via the electrical control line.

6. The downhole assembly of claim 2, wherein the controller is operable for recognizing the plurality of activation signals from a plurality of other signals received via the electrical control line, wherein the plurality of activation signals is addressed to the controller and at least one of the plurality of other signals is addressed to another downhole tool.

7. The downhole assembly of claim 2, wherein the controller is operable for storing data corresponding to the operation of the pressurizing module.

8. The downhole assembly of claim 1, wherein the pressurizing module comprises:

a second chamber;

a rupture disk, wherein the rupture disk is operable for preventing communication of a fluid into the second chamber;

a puncture tool, wherein the puncture tool is operable for puncturing the rupture disk in response to the respective activation signal of the plurality of activation signals such that communication of the fluid into the second chamber is allowed;

a setting element, wherein the setting element is operable for moving in response to the communication of the fluid into the second chamber, wherein movement of the setting element is operable for communicating a force to the reservoir, wherein the reservoir is operable for communicating at least the quantity of control fluid via the fluid control path in response to the force communicated by the setting element.

9. The downhole assembly of claim 8, wherein the downhole assembly is coupleable with a segment of production tubing for actuating the packer without using a port providing fluid communication with a source of internal tubing pressure of the segment of production tubing.

10. The downhole assembly of claim 8, wherein the packing element comprises an elastomeric element.

11. The downhole assembly of claim 8, wherein the packing element further comprises a slip element movable in a radial direction in response to the compression force.

12. The downhole assembly of claim 8, wherein the packer tool is positionable closer to a well head of the wellbore than the pressurizing module for allowing a release of fluid into the wellbore from the pressurizing module without affecting the expansion of the packing element after the packing element has been expanded.

13. The downhole assembly of claim 8, wherein the pressurizing module comprises an actuator, wherein the actuator is operable for applying a force to the reservoir in response to receiving the respective activation signal, wherein the reservoir is operable for communicating at least the quantity of control fluid via the fluid control path in response to the force.

14. The downhole assembly of claim 8, further comprising a pyrotechnic charge positioned adjacent to the puncture tool, wherein the pyrotechnic charge is operable for detonating in response to receiving the respective activation signal, wherein the puncture tool is operable for puncturing the rupture disk in response to a detonation of the pyrotechnic charge.

15. A downhole assembly for a wellbore, the downhole assembly comprising:

a packer tool;

a structure defining a fluid control path containing an amount of control fluid, the fluid control path operable for actuating the packer tool in response to a plurality of pressure changes in the fluid control path;

a pressurizing module coupled with the fluid control path, wherein the pressurizing module is operable for changing pressure in the fluid control path; and a controller electrically coupled with an electrical control line, wherein the controller is operable for receiving a plurality of activation signals via the electrical control line and operating the pressurizing module to produce the plurality of pressure changes in the fluid control path for actuating the packer tool in response to the plurality of activation signals, wherein an amount of each of the plurality of pressure changes is controlled by a respective activation signal of the plurality of activation signals, wherein the packer tool further comprises:

a chamber in fluid communication with the fluid control path of the packer tool, a compression element in fluid communication with the chamber, wherein the compression element is movable in response to communication of a quantity of control fluid via the fluid control path to or from the chamber, and a packing element adjacent to the compression element and expandable in response to a compressive force applied to the packing element by a movement of the compression element.

16. The downhole assembly of claim 15, wherein the pressurizing module comprises a pump.

17. The downhole assembly of claim 15, wherein the pressurizing module comprises an actuator.

* * * * *